US009730538B2

(12) United States Patent
Maslana et al.

(10) Patent No.: US 9,730,538 B2
(45) Date of Patent: Aug. 15, 2017

(54) SURFACE TENSION CONDIMENT DISPENSER

(71) Applicant: Prince Castle LLC, Carol Stream, IL (US)

(72) Inventors: Eugene S. Maslana, Morton Grove, IL (US); Karl Heinze, West Chicago, IL (US)

(73) Assignee: Prince Castle LLC, Carol Stream, IL (US)

( * ) Notice: Subject to any disclaimer, the term of this patent is extended or adjusted under 35 U.S.C. 154(b) by 0 days.

(21) Appl. No.: 14/928,350

(22) Filed: Oct. 30, 2015

(65) Prior Publication Data

US 2016/0129463 A1 May 12, 2016

Related U.S. Application Data

(60) Provisional application No. 62/077,017, filed on Nov. 7, 2014.

(51) Int. Cl.
*B05B 11/00* (2006.01)
*A47G 19/18* (2006.01)

(52) U.S. Cl.
CPC ..... *A47G 19/18* (2013.01)

(58) Field of Classification Search
CPC ..... A47G 19/18; A47G 19/183; A47G 2400/027; A47J 9/001
See application file for complete search history.

(56) References Cited

U.S. PATENT DOCUMENTS

| | | | | |
|---|---|---|---|---|
| 3,150,802 | A * | 9/1964 | Pribyl | A23G 3/203 222/309 |
| 3,231,149 | A * | 1/1966 | Yuza | A23G 3/28 137/853 |
| 3,260,419 | A * | 7/1966 | Weimer | A47G 19/183 222/309 |
| 6,520,380 | B1 * | 2/2003 | Veltrop | G01F 11/025 222/135 |
| 2012/0024887 | A1 * | 2/2012 | Heinze | A47G 19/183 222/1 |
| 2016/0129463 | A1 * | 5/2016 | Maslana | A47G 19/18 222/341 |

* cited by examiner

*Primary Examiner* — Frederick C Nicolas
*Assistant Examiner* — Bob Zadeh
(74) *Attorney, Agent, or Firm* — Andrus Intellectual Property Law, LLP

(57) ABSTRACT

A condiment dispenser dispenses a portion of a condiment held within a reservoir. The condiment dispenser includes a housing that defines the reservoir and a piston assembly that is translatable within the housing between a first position and a second position. A chamber insert is connected to a dispensing end of the housing and the chamber insert includes an insert bottom wall and at least one orifice extending through the insert bottom wall. A sealing ring is engageable with the seat of the piston assembly and a bottom wall includes at least one nozzle and is disposed below the chamber insert to define a void between the bottom wall and the insert bottom wall.

20 Claims, 13 Drawing Sheets

SURFACE TENSION CONDIMENT DISPENSER

CROSS-REFERENCE TO RELATED APPLICATION

The present application claims priority of U.S. Provisional Patent Application No. 62/077,017, filed on Nov. 7, 2014, the content of which is hereby incorporated herein by reference in its entirety.

BACKGROUND

The present disclosure relates to the field of food preparation. More specifically, the present disclosure relates to a dispenser for condiments.

Commercial restaurants, including fast-food restaurants require both fast and consistent preparation of food. To this end, condiment dispensers are used in an effort to consistently portion out liquid or viscous food products such as ketchup, mustard, and liquid margarine onto a sandwich or other food product being prepared.

Currently available condiment dispensers employ mechanical pumps that discharge the food product onto the food being prepared. Mechanical pumps include valve devices that are pumped to be filled with the food product from a reservoir and then to discharge the portioned volume of product through some form of nozzle onto the food. The valve devices are either mechanical in nature with machined or molded parts with some form of return spring. An exemplary embodiment of such is disclosed in U.S. Patent Application Publication No. 2012/0024887 entitled "Liquid Butter Dispenser", which is incorporated herein by reference in its entirety. Alternatively, the valve is a flexible diaphragm that releases under pressure to allow fluid flow. In currently available dispensers, these parts are hard to assemble, difficult to clean, fragile in nature, require periodic replacement, and/or are easily lost when the device is disassembled.

BRIEF DISCLOSURE

An exemplary embodiment of a condiment dispenser includes a housing defining a reservoir. A piston assembly includes a piston rod and a seat. The piston assembly is translatable within the housing between a first position and a second position. A chamber insert is connected to a dispensing end of the housing. The chamber insert includes an insert bottom wall and at least one orifice extending through the bottom wall. A biasing spring extends between the chamber insert and the piston assembly and biases the piston assembly in the first position. A sealing ring is engageable with the seat of the piston assembly. A bottom wall includes at least one nozzle. The bottom wall disposed below the chamber insert to define a void between the bottom wall and the insert bottom wall.

An additional exemplary embodiment of a condiment dispenser includes a bottom wall. The bottom wall defines a dispensing end of the condiment dispenser. The bottom wall includes at least one nozzle. A housing defines a reservoir. A chamber insert is located at least partially within the housing and between the reservoir and the bottom wall. The chamber insert includes an insert bottom all and at least one orifice that extends through the insert bottom wall. A void is defined between the bottom wall and the insert bottom wall. A piston assembly includes a seat. The piston assembly is translatable within the housing and the chamber insert between a first position and a second position. A biasing spring extends between the chamber insert and the piston assembly and biases the piston assembly in the first position. The sealing ring is engageable with the seat of the piston assembly. Translation of the piston assembly between a first position and the second position translates the sealing ring between a first position and a second position.

An exemplary embodiment of a system for dispensing includes a housing which defines a reservoir and a dispensing end. The dispensing end is further defined by a bottom wall which includes at least one nozzle. A chamber insert is located within the housing and adjacent the dispensing end between the reservoir and the bottom wall. The chamber insert includes an insert bottom wall and an inner chamber. The inner chamber is defined by an inner wall extending from the insert bottom wall. A plurality of orifices extend through the bottom wall within the inner chamber. Each of the orifices of the plurality of orifices have a length and a diameter. The lengths of the orifices are each greater than the respective diameters of the orifices. A void is defined between the bottom wall and the insert bottom wall. A piston assembly includes an upper seat and a lower seat. The piston assembly is translatable within the housing and the chamber insert between a first position and a second position. A biasing spring extends between the chamber insert and the piston assembly. The biasing spring biases the piston assembly in the first position. A first sealing ring is engageable with the inner chamber and the upper seat of the piston assembly. A second sealing ring is engageable with the inner chamber and the lower sear of the piston assembly. One of the first sealing ring and the second sealing ring is positioned within the condiment dispenser. If the first sealing ring is positioned within the condiment dispenser, the condiment dispenser dispenses a portion of condiment with a first portion volume. If the second sealing ring is positioned within the condiment dispenser, the condiment dispenser dispenses the portion of condiment with a second portion volume.

DETAILED DISCLOSURE

Embodiments of the condiment dispenser as disclosed in further detail herein are configured to dispense food products, exemplarily viscous or liquid food products. The food products dispensed may include, but are not limited to, ketchup, mustard, mayonnaise, salad dressing, barbeque sauce, and liquid margarine, although these are not intended to be limiting and are rather intended to merely exemplary of the types of food products that may be dispensed with embodiments of the condiment dispenser as disclosed herein.

Figure 1:
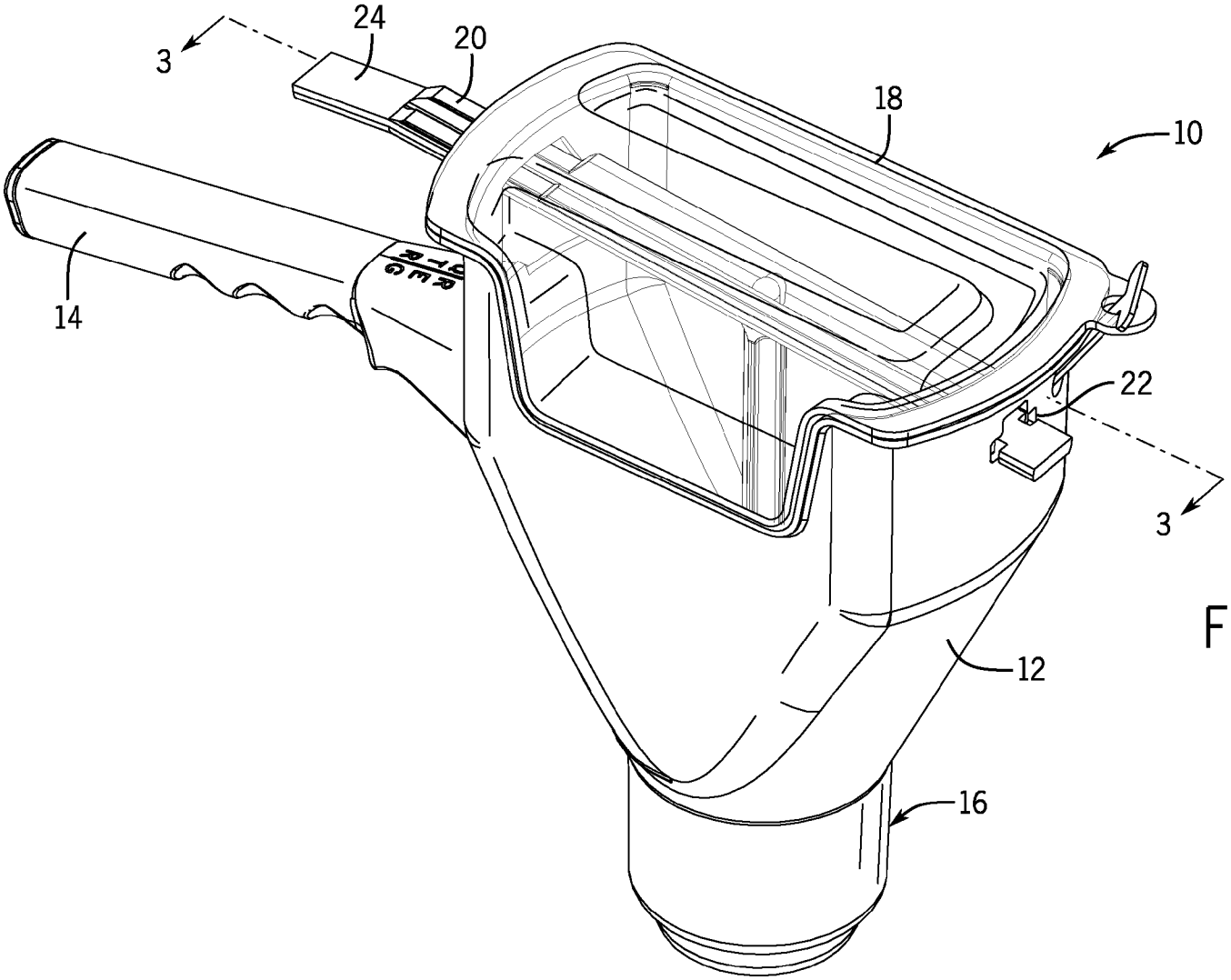
FIG. 1 is a front perspective view of an exemplary embodiment of a condiment dispenser.

FIG. 1 depicts an exemplary embodiment of a condiment dispenser 10. The condiment dispenser 10 includes a housing 12 and a handle 14. The liquid or viscous food to be dispensed is held within an open interior or the housing 12. The condiment dispenser 10 includes a dispensing end 16 at one end and through which the food is dispensed. The condiment dispenser 10 also exemplarily includes a lid 18 at an opposite end. In an exemplary embodiment, the housing 12 is frustoconical in shape while the dispensing end 16 may be cylindrical. Such shape generally funnels the liquid or viscous food through the housing 12 towards the dispensing end 16 by a gravity feed.

Figure 2:
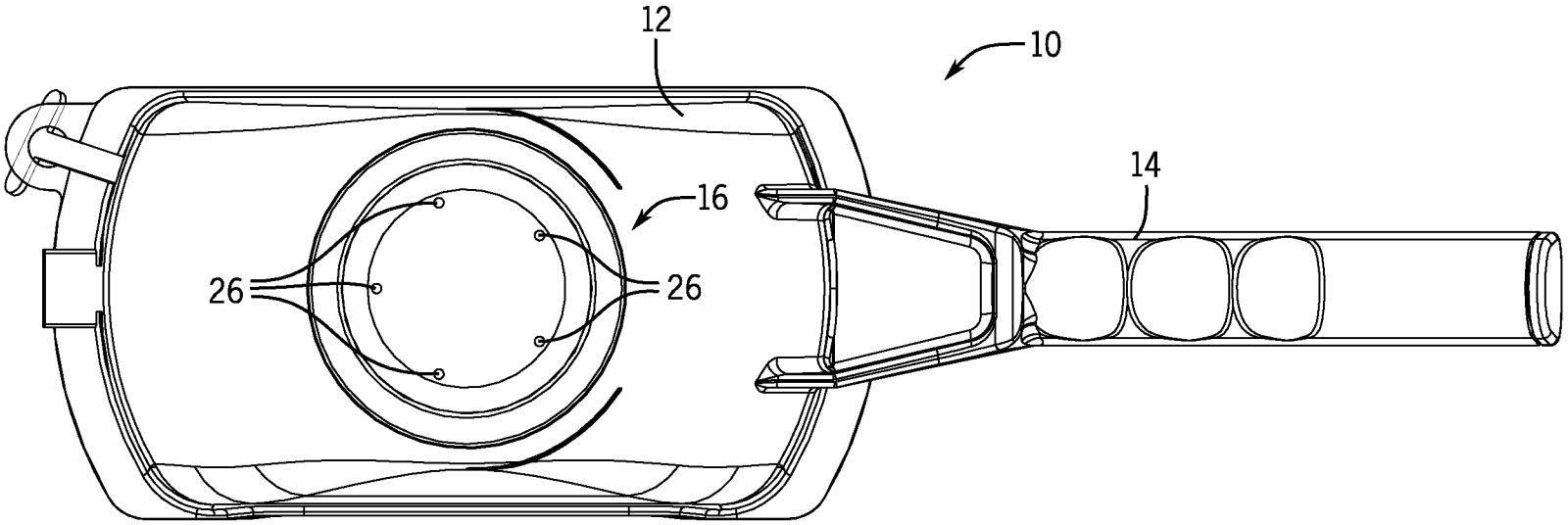
FIG. 2 is a bottom view of an exemplary embodiment of a condiment dispenser.

In an exemplary embodiment, the lid 18 may be constructed of a clear to translucent material such that an operator of the condiment dispenser 10 may view a general level of food product within the housing 12. The condiment dispenser 10 further includes a lever 20. The lever 20 exemplarily extends through the housing 12 to rest at one end in a fulcrum hole 22 through the housing 12. An operator places a force on an operable end 24 of the lever 20 to move the lever 20 about the fulcrum hole 22 in order to operate the condiment dispenser 10 as described in further detail herein. The user exemplarily actuates the operable end 24 of the lever 20 with the user's thumb while the rest of the user's hand grips the handle 14. As can be seen through the translucent lid 18 depicted in FIG. 1, a piston rod 28 extends from the lever 20 further into the open interior of the housing 12. FIG. 2 is an exemplary bottom view of the condiment dispenser 10. In the bottom view of the condiment dispenser 10 depicted in FIG. 2, a plurality of nozzles 26 can be seen through the bottom of the dispensing end 16 of the condiment dispenser 10. As will be described in further detail herein, in an exemplary embodiment, the nozzles 26 are arranged generally at an outside perimeter of the dispenser end. However, it will be recognized that a particularly pattern of the dispensed food may be desired. In such circumstances one or more dispensing ends 16 may be provided with a predetermined pattern of nozzles 26. Therefore, embodiments of the condiment dispenser 10 may include dispensing ends 16 with various numbers and arrangements of nozzles 26 and in some embodiments interchangeable arrangements of nozzles.

Figure 3:
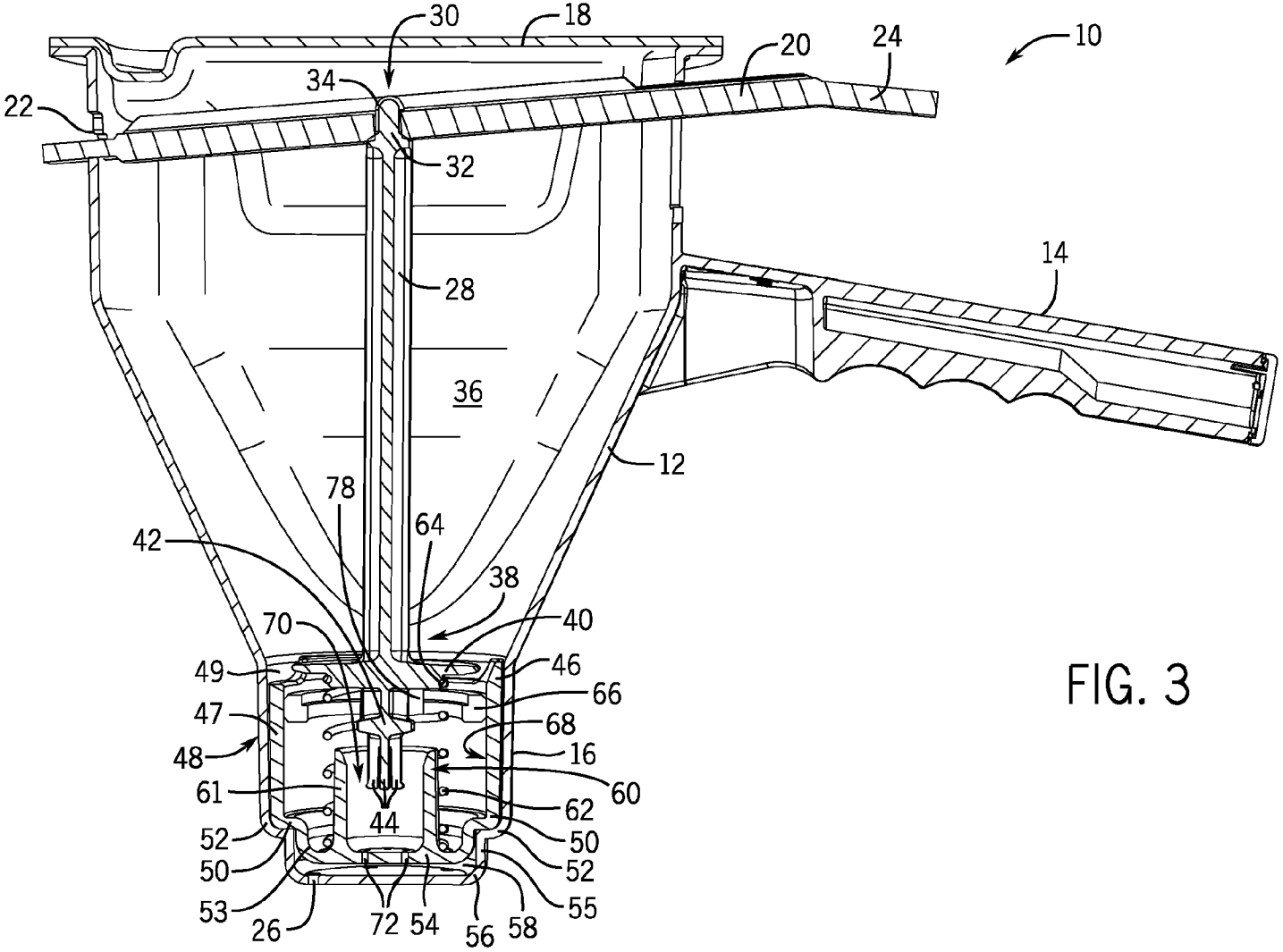
FIG. 3 is a side sectional view exemplarily taken along like 3-3 of FIG. 1 and exemplarily configured to dispense ketchup.

FIG. 3 is a sectional view of the condiment dispenser 10 as exemplarily taken along line 3-3 of FIG. 1. In the sectional view, the lever 20 is exemplary in the up or ready position. The lever 20 is mechanically connected to a piston rod 28 at a pivot joint 30 wherein a piston rod 28 is moveably retained with in a recess 34 in the lever 20. The piston rod 28 extends through the open interior of the housing 12, including through a reservoir 36. In embodiments, the reservoir 36 is frustoconical in shape and when the condiment dispenser 10 is in use, the food product to be dispensed is retained within the reservoir 36. As previously noted, the frustoconical shape facilitates a gravity feed of the food product towards the dispensing end 16. A piston assembly 38 includes the piston rod 28 and further includes at least one seat as described in further detail herein. In the embodiment depicted, the piston assembly 38 includes an upper seat 40 and a lower seat 42. A plurality of fingers 44 extend away from the lower seat to form the lower end of the piston assembly 38.

A chamber insert 46 is inserted interior of a dispensing end 48 of the housing 12. It is understood that in the embodiment depicted in FIG. 5, the dispensing end 48 of the housing 12 generally coincides with the dispensing end 16 of the entire condiment dispenser. In an embodiment, the chamber insert 46 is generally a cylindrical shape, which in an exemplary embodiment matches and is coaxial to a cylindrical shape of the dispensing end 48. The chamber insert 46 includes a (e.g. cylindrical) sidewall 47 which terminates at a lower end with an annular lip 50. An annular wall 53 extends below the annular lip 50 at a position radially interior of the sidewall 47. The chamber insert 46 ends with a insert bottom wall 54 extending between the annular wall 53. While this embodiment is described as being cylindrical, it will be understood that other arrangements and shapes may be used in other embodiments. The annular lip 50 engages a corresponding annular lip 52 of the dispensing end 48. The engagement of the respective annular lips 50, 52 positions the chamber insert 46 within the dispensing end 48 such that the insert bottom wall 54 of the chamber insert 46 is positioned spaced apart from the bottom wall 56 of the dispensing end 48 to create a void 58 therebetween. It will be recognized that in another embodiment, the annular wall 53 may be eliminated with a corresponding reduction in the size of the lower housing wall 55 to maintain the void 58 as described herein.

An inner chamber 60 extends upward from the insert bottom wall 54 of the chamber insert 46 into the open interior of the chamber insert 46. In an exemplary embodiment, the inner chamber 60 is cylindrical in shape and defined by a (e.g. cylindrical) wall 61. A biasing spring 62 is held in position, exemplarily by a friction fit with the wall 61 of the inner chamber 60 and the biasing spring 62 extends upwards from the insert bottom wall 54 of the chamber insert 46 into the open interior of the chamber insert 46. In an embodiment, the biasing spring 62 engages an interior lip 64 of the upper seat 40, such that the biasing spring 62 is secured to the upper seat 40, and thereby secured to the rest of the piston assembly 38. The biasing spring 62 places a biasing force against the piston assembly 38 which biases the piston assembly 38 and the lever 20 into the up or ready position. This position is exemplarily depicted in FIG. 3.

The embodiment of the condiment dispenser 10 depicted in FIG. 3 is exemplarily configured to dispense ketchup, which is exemplarily a larger dispense volume than may be used with an alternative condiment, exemplary mustard. In one merely exemplary embodiment, one ounce of ketchup may be dispensed with the dispenser as configured in FIG. 3. As will be described herein in further detail, FIG. 4 exemplarily depicts an embodiment configured to dispense a smaller portion, e.g. one-half ounce, exemplarily of mustard.

Referring back to FIG. 3, the condiment dispenser 10 includes a sealing ring 66 which is dimensioned to sealingly engage against an interior surface 68 of the side wall 47 of the chamber insert 46. However, the sealing ring 66 is constructed and arranged such that the sealing ring 66 "floats" relative to the piston assembly 38, in that the sealing ring 66 is not secured to the upper seat 40 of the piston assembly, but rather is moveable within the chamber insert 46 in a region bounded by the upper seat 40. In an exemplary embodiment, the sealing ring 66 is constructed of a solid piece of elastomeric material, although it will be recognized that other construction may be used. When the condiment dispenser 10 is arranged in the up or ready position, food product held in the reservoir 36 is free to flow along arrow 70 between the upper seat 40 and the sealing ring 66 in order to fill the chamber insert 46 with food product to be dispensed. In am embodiment, the chamber insert 46 includes a wall 47. Cut outs 49 in the top of the wall 47 may facilitate the flow of food product into the chamber insert 46 from the reservoir 36 past the seat 40 and sealing ring 66.

As will be described in further detail herein, as the lever 20 and piston assembly 38 are moved downward, the force applied by a user to the end 24 of the lever 20 overcomes the force of the biasing spring 62 against the upper seat 40. As the piston assembly 38 moves downward within the housing 12, the upper seat 40 engages the sealing ring 66 in a sealing manner to close the fluid connection between the reservoir 36 and the chamber insert 46, defining the portion of food product to be dispensed. Further actuation of the piston assembly 38, with the upper seat 40 and the sealing ring 66 interior of the chamber insert 46 forces the food product through the inner chamber 60 and out of one or more orifices 72 in the insert bottom wall 54 of the chamber insert 46. The food product, under pressure from the piston assembly 38 flows through the orifices 72 into the void 58. The food product is dispensed out of the condiment dispenser 10 through the plurality of nozzles 26 in the bottom wall 56 of the dispensing end 48. Upon release of the lever 20, the biasing spring 62 returns the piston assembly 38 to the ready or up position. As the piston assembly moves within the dispenser, fingers 78 engage the sealing ring 66 as described in further detail herein and move the sealing ring 66 upwards along with the piston assembly 38 back to the original position of the sealing ring 66 depicted in FIG. 3. This operation as well as further exemplary embodiments of the condiment dispenser 10 will be described in further detail herein.

Figure 4:
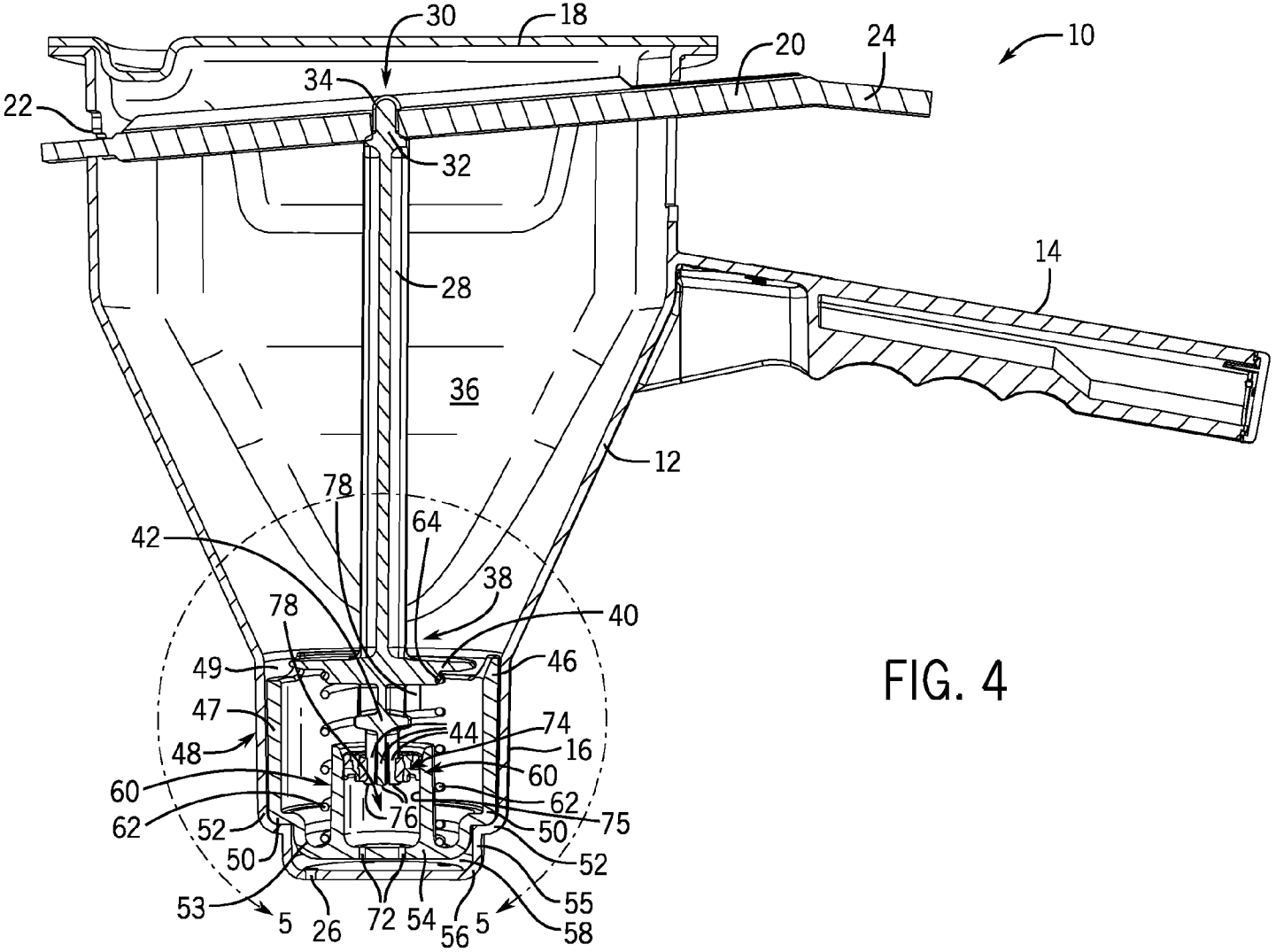
FIG. 4 is a side sectional view exemplarily taken along line 3-3 of FIG. 1 and exemplarily configured to dispense mustard.

FIG. 4 is a cross sectional view of an exemplary embodiment of a condiment dispenser 10 as taken along line 3-3 of FIG. 1. In the exemplary embodiment depicted in FIG. 4, the condiment dispenser 10 is arranged to dispense a different volume portion of condiment than dispensed by the condiment dispenser 10 arranged in the manner depicted in FIG. 3. Exemplarily, the condiment dispenser 10 may dispense mustard. In FIG. 4, like reference numerals have been used to reference like structures as already previously described with respect to FIG. 3. This is done for the purposes of clarity and conciseness, and also to highlight the features of the additional embodiment depicted and described herein. FIGS. 3 and 4 further highlight that in an exemplary embodiment, the predefined portion volume can be adjusted by replacement of single piece, the sealing ring.

In the condiment dispenser 10 of FIG. 4, a sealing ring 74 is annularly disposed within the inner chamber 60 against an interior surface 75 of the wall 61 that defines the inner chamber 60. While the sealing ring 74 is depicted in FIGS. 4-5D as having a three-part construction, exemplarily including a resilient inner portion, a middle stiffening portion and an outer gasket, it will be recognized that the sealing ring 74 may be provided in a variety of other constructions, including a construction similar to the sealing ring 66. The sealing rings may exemplarily be a solid or unitary construction and may exemplarily, but not limited to, be of a plastic, elastomeric, nylon, or polymer material. The fingers 44 of the piston assembly 38 extend through the sealing ring 74. The sealing ring 74 "floats" within the inner chamber 60 in that it is independently moveably from the piston assembly 38. However, movement of the sealing ring 74 is bounded at the top by the position of the lower seat 42 of the piston assembly 38 and bounded at the bottom end by the position of the flanges 76 extending from the bottom of the fingers 44 of the piston assembly 38. Therefore, when the lever 20 and piston assembly 38 are in the up or ready position as depicted in FIG. 4, food product is able to flow from the reservoir 36 along arrow 78 into the inner chamber 60 between the lower seat 42 and the sealing ring 74 and through gaps between the fingers 44 of the piston assembly 38.

Figure 5A:
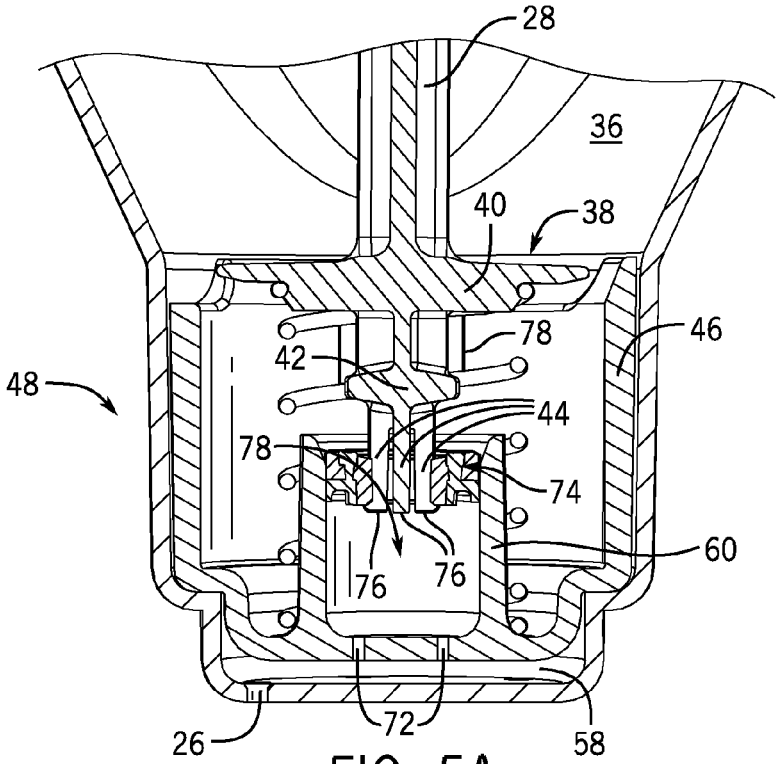
FIGS. 5A-5D depict close up sectional views of the region identified as 5-5 in FIG. 4, exemplarily depicting operation of a condiment dispenser.
Figure 5B:
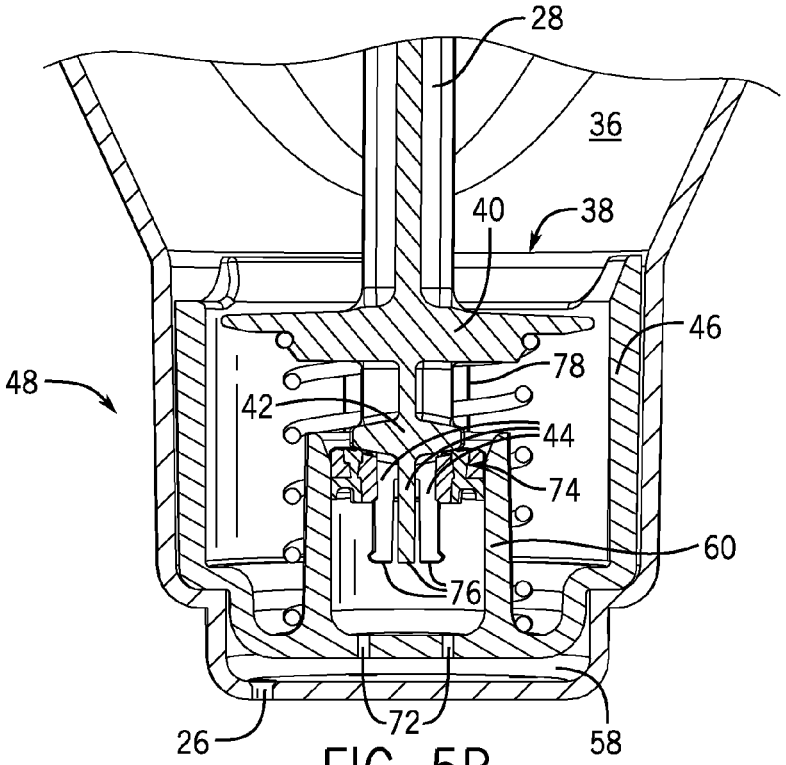
Figure 5C:
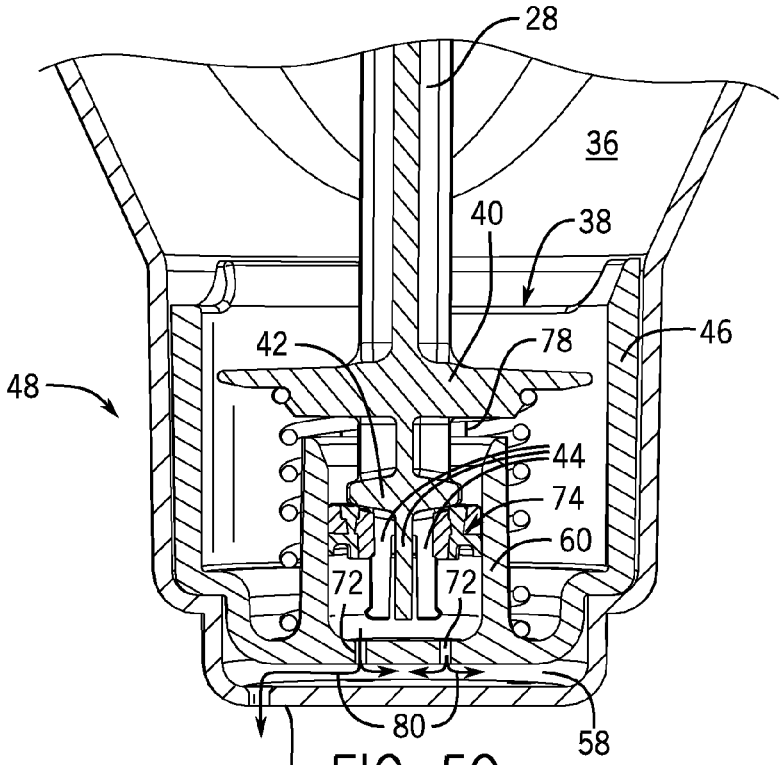
Figure 5D:
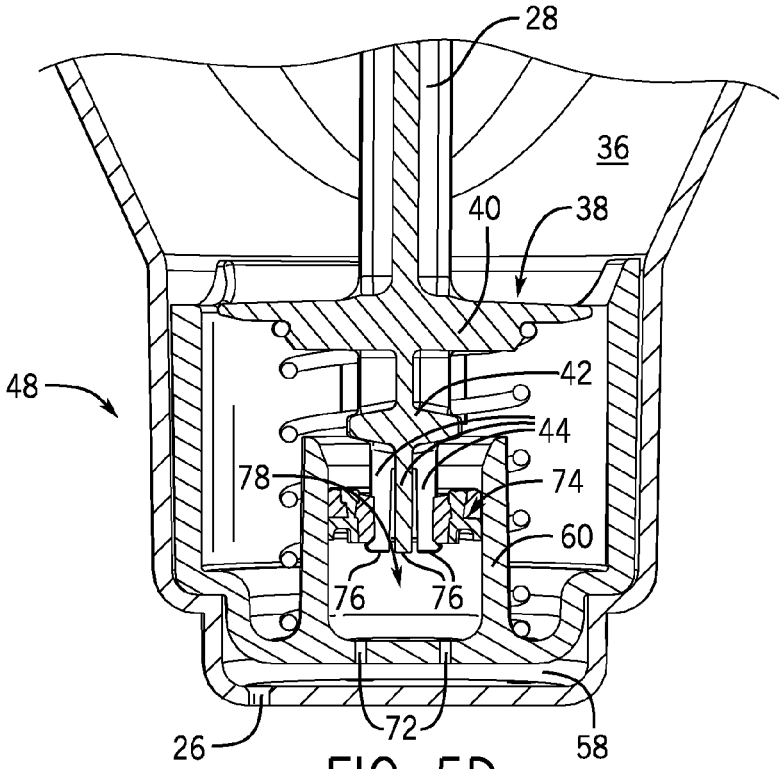

FIGS. 5A-5D depict a closer view of the region defined by lines 5-5 in FIG. 4 and exemplarily depict this region of the condiment dispenser 10 as the lever (not depicted) and piston assembly 38 are moved to various operable positions through the operation of the condiment dispenser. FIG. 5A depicts a dispending end 48 of the condiment dispenser arranged in the up or ready position, as previously described above with respect to FIG. 4. In this position, the food product is able to flow along arrow 78 from the reservoir 36 into the interior of inner chamber 60. This loads the inner chamber 60 of the dispenser with food product to be dispensed during the next actuation of the condiment dispenser. The food product flows by gravity feed from the reservoir 36, through the space between the valve seat 40 and the wall 47 of the chamber insert 46, and then through the spaces between the fingers 44 of the piston assembly 38 into the inner chamber 60. It will be recognized that in the embodiment depicted, the food product flows through the spaces between the fingers 44 and through the sealing ring 74 slidably located within the inner chamber 60. In another embodiment, as depicted in FIG. 3, the food product flows between the upper seat 40 and the sealing ring 66 located within the chamber insert 46.

During operation of the condiment dispenser 10, as the user presses down on the lever (not depicted) against the biasing force applied by the biasing spring (not depicted) the piston assembly 38 moves downward radially interior of the chamber insert 46 and the lower seat 42 sealingly engages the sealing ring 74. At this point, the inner chamber 60 has filled with food product to be dispensed with the present actuation of the condiment dispenser. After an initial loading or dispense out of the condiment dispenser, food product exists within the orifices 72, void 58 and nozzle 26. The orifices 72 are exemplarily dimensioned such that the orifices have a high aspect ratio in that the length of the orifice is much greater than the diameter. In one merely exemplary embodiment the ratio of the length of the orifice is at least 1.7 times the diameter of the orifice. In other exemplary embodiment the ratio of the length of the orifice to the diameter of the orifice may be between 1.2 and 2.5. In some embodiments, a preferred orifice length to diameter ratio may be predetermined based upon the product to be dispensed, including, but not limited to, a viscosity or another physical property of the food product.

Non-Newtonian fluids are those fluids in which the viscosity is dependent upon shear rate. Ketchup and mustard are exemplary of food products which are non-Newtonian fluids. Ketchup and mustard exhibit "shear thinning" such that their viscosities decrease when the fluids undergo high stress. In exemplary embodiments, dispensing of non-Newtonian fluids present particular operational advantages.

The orifices 72, void 58, and nozzles 26 are therefore dimensioned to provide surface tension in a manner that resists flow of food product through the orifices 72, void 58, and nozzles 26. This prevents the unintended "leakage" that occurs in dispensers when the volume of food product that exists within the void 58 flows out of the nozzles 26. In order for food product to leak out of the nozzles 26, a volume of air must first pass through the void 58. Due to the surface tension within the orifices 72, fluid flow is sufficiently constrained to minimize any volume of air able to move through the relatively small volume of the void 58, which is necessary to displace the volume of food product to cause leakage. Thus, these embodiments are able to prevent leakage between dispensing operations.

However, the dispenser operates to overcome the surface tension within the orifices 72, void 58, and nozzles 26 in part by applying shear force to induce shear thinning in the food product, during each dispensing operation. In the dispensing operation, the piston assembly 38 is moved downward into the chamber insert 46 pushing the sealing ring 74 and lower seat 42 down within the inner chamber 60. First, as the bias of the spring 62 is overcome, the piston assembly 38 moves downward until the lower seat 42 engages the sealing ring 74, as depicted in FIG. 5B. This closes the inner chamber 61. It will be recognized that in the embodiment depicted in FIG. 3, the upper seat 40, will engage the sealing ring 66. Next, as the piston assembly 38 is forced downwards further, the sealing ring 74 is forced downwards within the inner chamber 60. This is depicted in FIG. 5C. Movement of the sealing ring and lower seat 42 down within the inner chamber 60 forces the food product contained within the inner chamber 60 out through the orifices 72 into the void 58. The shearing of the food product through the orifices 72 causes the viscosity of the food product to decrease, which facilitates flow of the dispensed portion of food product through the void 58 and nozzles 26, exemplarily along arrow 80.

After the portion of the food product has been dispensed from the condiment dispenser, the food product in the orifices 72, void 58, and nozzles 26 is no longer under pressure and the shear force decreases, this in turn increases the viscosity of the food product and the surface tension of the food product in a viscous state prevents further flow of food product. The user releases force on the lever (not depicted) and piston assembly 38 and the biasing spring 62 returns the piston assembly 38 to its original or up or ready position as depicted in FIG. 5D. In this return of the piston assembly 38, the flanges 76 of the fingers 44 of the piston assembly 38 engage the sealing ring 74 and pull the sealing ring 74 upwards within the inner chamber 60 to return the sealing ring 74 to its up or ready position. With the pathway cleared, the inner chamber 60 refills with food product and the surface tension of the food product in the orifices 72, void 58, and nozzles 26 prevents flow of food product from the inner chamber 60 therethrough, despite the head pressure created by the food product in the reservoir.

During return movement of the piston assembly 38 and the sealing ring 74 back to the ready or up position, a localized back pressure may be created within the inner chamber 60. However, the surface tension of the food product within the orifices 72, void 58, and nozzles 26 prevent movement of the food product located in the nozzle 26, void 58, and orifices 72 into the inner chamber 60 as a result of this back pressure. This further facilitates operation of the condiment dispenser as a "prime" of the condiment dispenser is maintained in between dispensing cycles and this operational volume need not be refilled upon the next dispensing operation. In some instances, the back pressure may still result in a small amount of backward flow of food product in the direction from the nozzles 26 to the void 58 to the orifices 72 to the inner chamber 60; however, this flow is resisted by the aforementioned surface tension. This back flow may result in a small pocket of air being formed within the void 58 about the nozzles 26. In an embodiment, this air pocket can help to keep the nozzles clear of food product and resist clogging as time passes between dispenses.

Additionally, in embodiments the small volume of food product within the void 58 combined with the surface tension of the food product within the orifices 72, void 58, and nozzles 26 ensure that a minimal static head of food product is applied to the nozzles 26. This minimal static head thus further minimizes leakage as there is little force that exists against the food product within the nozzles 26 and therefore the surface tension of the food product within the nozzles 26 further prevents leakage of food product between dispensing operations. It will be recognized that while some embodiments as disclosed herein dispense non-Newtonian fluids, other food products dispensed may not exhibit the same shear thinning property as described above.

Figure 6:
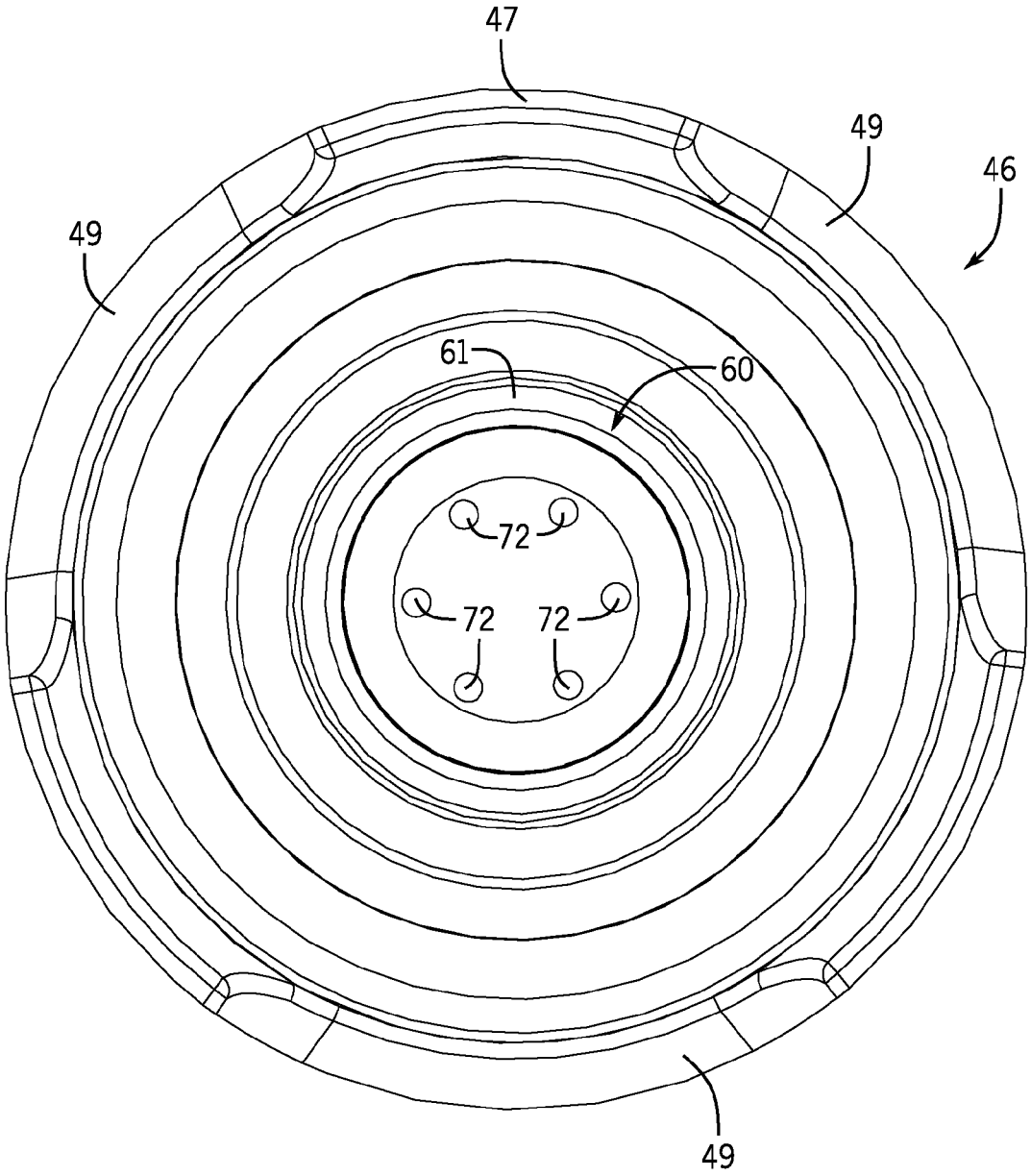
FIG. 6 is a top view of an exemplary embodiment of the chamber insert.

FIG. 6 is an exemplary perspective view of an embodiment of a chamber insert 46 as may be used in connection with embodiments of the condiment dispenser as disclosed herein. FIG. 6 exemplary depicts the wall 47 that defines the chamber insert 46 and the wall 61 that defines the inner chamber 60. Orifices 72 are arranged around the perimeter at the bottom of the inner chamber 60. FIG. 6 further depicts cut-outs 49 in the upper perimeter of the wall 47. In embodiments, the cut-outs may facilitate flow of the food product from the reservoir (not depicted) into the chamber insert 46.

Figure 7:
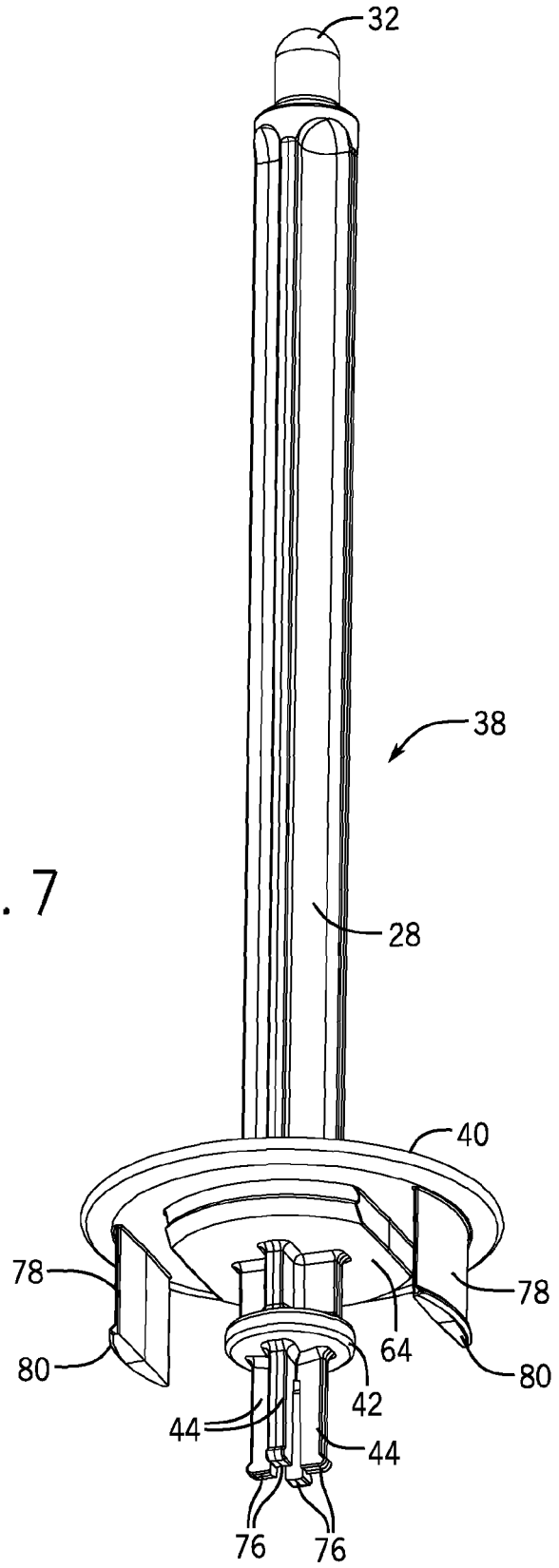
FIG. 7 is a perspective view of a piston assembly as exemplarily used in embodiments of the condiment dispenser.

FIG. 7 depicts an exemplary embodiment of the piston assembly 38. The piston assembly 38 includes the piston rod 28, head 32, upper seat 40, lower seat 42, fingers 44, flanges 76, and interior lip 62. The piston assembly 38 further includes at least one, and in embodiments more than one, finger 78 are spaced radially inwards from the outer perimeter of the upper seat 40, exemplarily by a distance commensurate with a dimension of the sealing ring 66 (as depicted in FIG. 3). The fingers 78 further each include flange 80 which projects radially outward from the finger 78. The fingers 78 and flange 80 exemplarily work in a similar manner as described above with respect to the fingers 44 and flanges 76. Specifically, in embodiments, such as depicted in FIG. 3, wherein the sealing ring 66 is located inside the chamber insert 46 in slideable connection to the interior surface 68 of the wall 47. Upon release of the lever by the user, the biasing spring 62 acts on the piston assembly 38 to return the piston assembly 38 to the ready or up position. The at least one finger 78 slides upwards along the sealing ring 66 until the at least one flange 76 engages the sealing ring 66 and further upward movement of the piston assembly 38 draws the sealing ring 66 upwards within the inner chamber 46 to an original position of the sealing ring 66, positioned for initial engagement with the upper seat 40 during the next dispense cycle.

Figure 8:
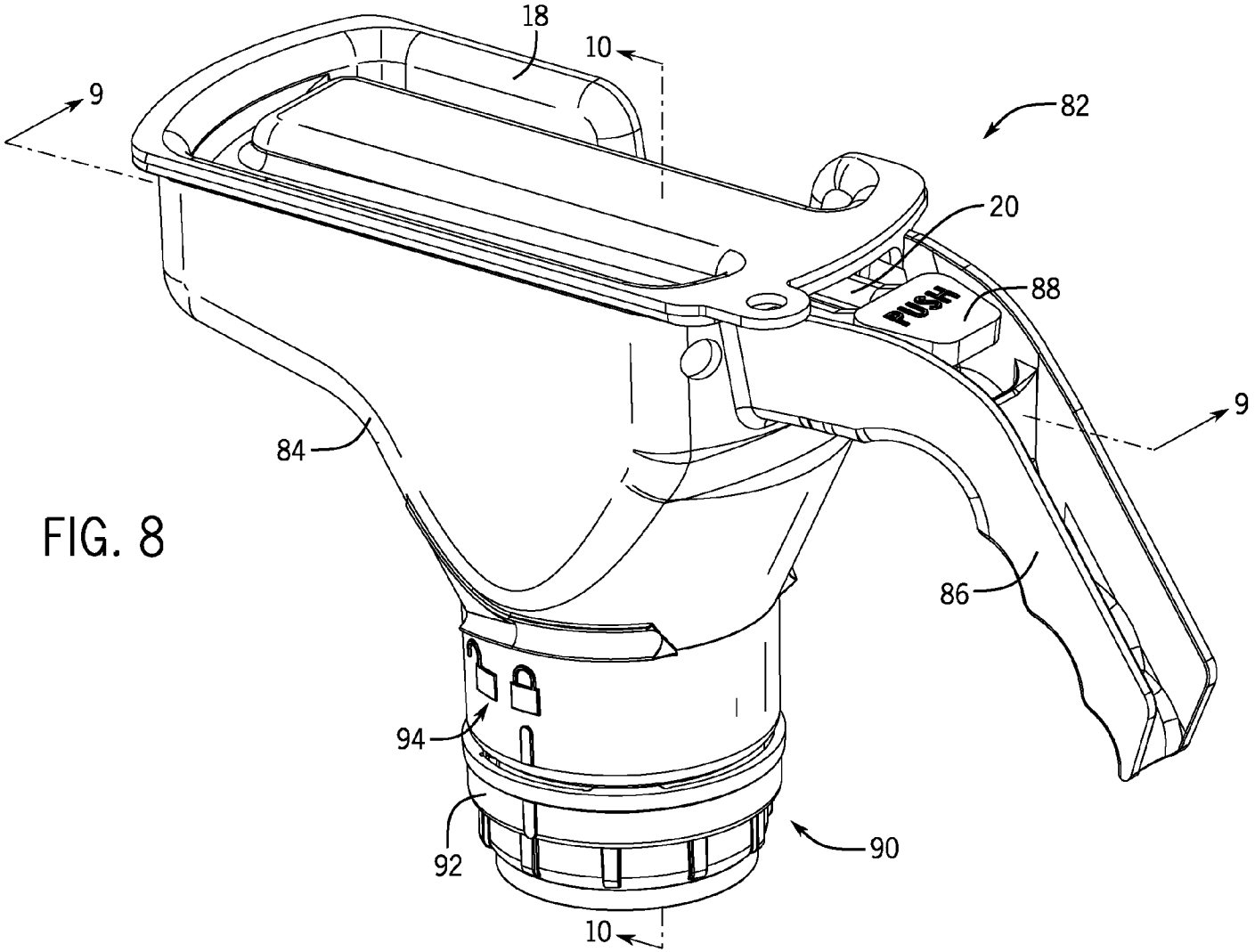
FIG. 8 is a perspective view of an exemplary alternative embodiment of the condiment dispenser.

FIG. 8 depicts an additional exemplary embodiment of a condiment dispenser 82. It will be noted that like reference numerals are used in the description to reference like structures, while the foregoing description focuses on those aspects between the embodiments that differ. The condiment dispenser 82 exemplarily depicts an additional arrangement of the housing 84 and handle 86. The handle 86 exemplarily achieves a different wrist position when holding the condiment dispenser 82 and an operable end 88 of the lever 20 is further arranged to facilitate this ergonomic alternative arrangement of the condiment dispenser 82.

The dispensing end 90 of the condiment dispenser 82 is further arranged in an alternative manner such that a dispensing cap 92 is secured to a lower end 94 of the housing 84. In an exemplary embodiment, the dispensing cap 92 is secured to the lower end 94 by a bayonet connection although it will recognized that in alternative embodiments other forms of threaded, friction fit, or resilient engagements may be used.

Figure 9:
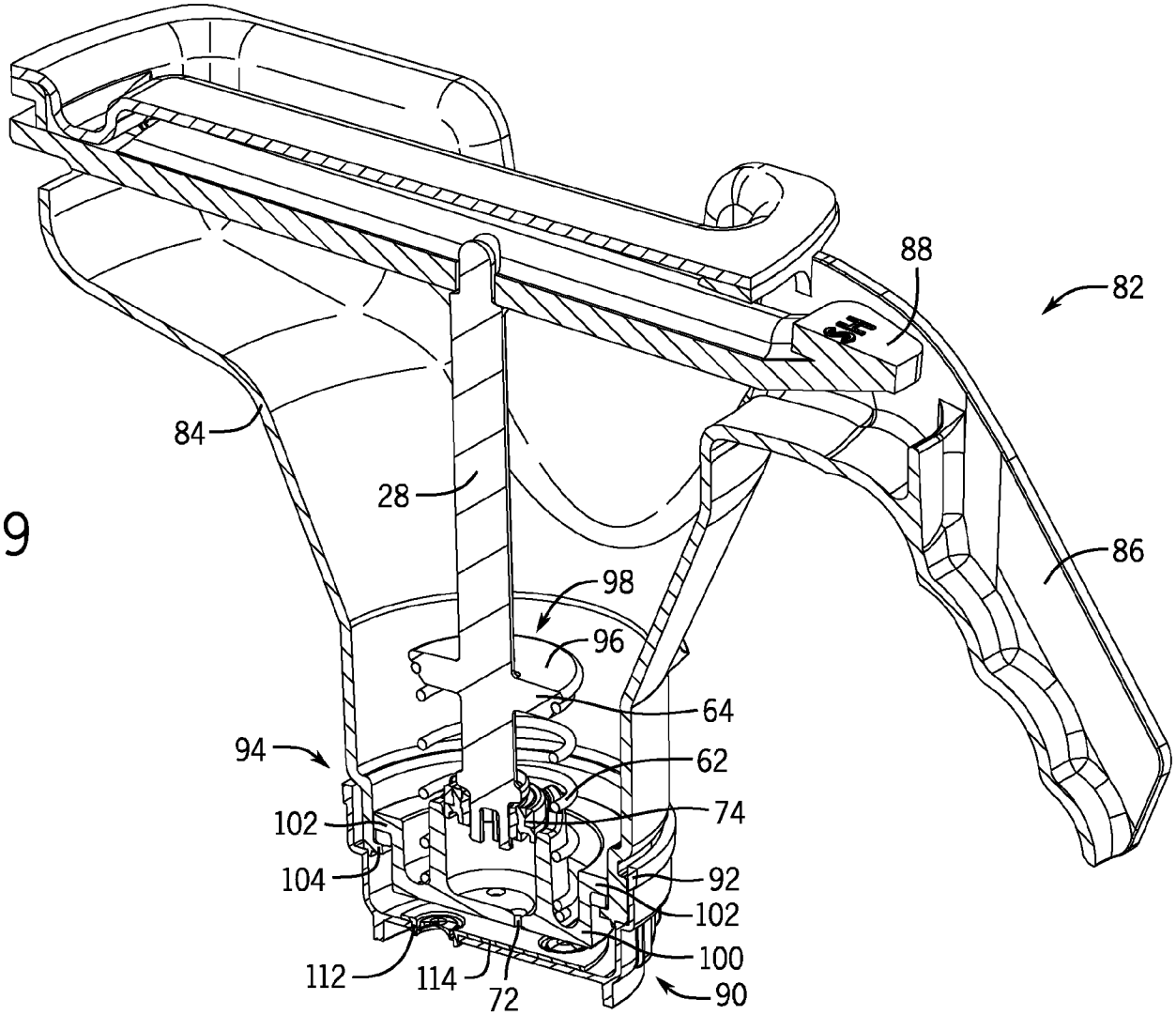
FIG. 9 is a perspective cut-away view taken along line 9-9 of FIG. 8.
Figure 10:
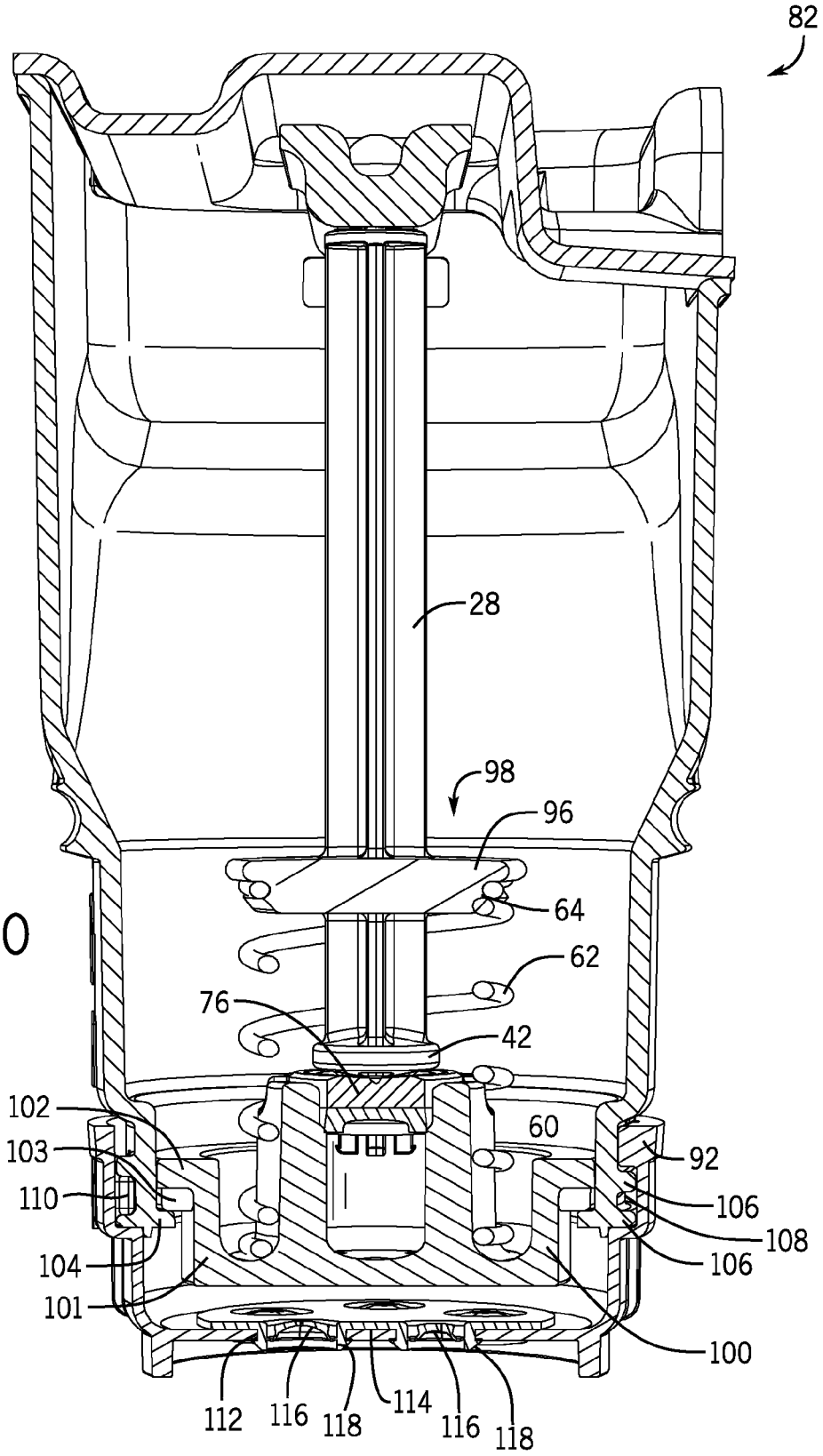
FIG. 10 is a sectional view exemplarily taken along line 10-10 of FIG. 8.

FIG. 9 is a perspective sectional view of the condiment dispenser 82 taken along line 9-9 in FIG. 8. FIG. 10 is a sectional view of the condiment dispenser 82 taken along line 10-10 in FIG. 8. Both of these Figures will be referenced simultaneously in the following description. In an exemplary embodiment, the embodiment of the condiment dispenser 82 as depicted herein may exemplarily be used to dispense liquid margarine in exemplarily the same manners as described above with respect to other food products. It will also be recognized that other food products may also be dispensed from embodiments of the condiment dispenser 82. Furthermore, liquid margarine presents the further difficulty of being generally more heat sensitive than other food products referenced herein, therefore a comparatively small change in temperature can change the state or viscosity of the liquid margarine. In an exemplary embodiment, the nozzle insert 114 as described in further detail herein is used as a precautionary feature against leakage due to a change in food product viscosity too low exemplarily due to heat.

Figure 11:
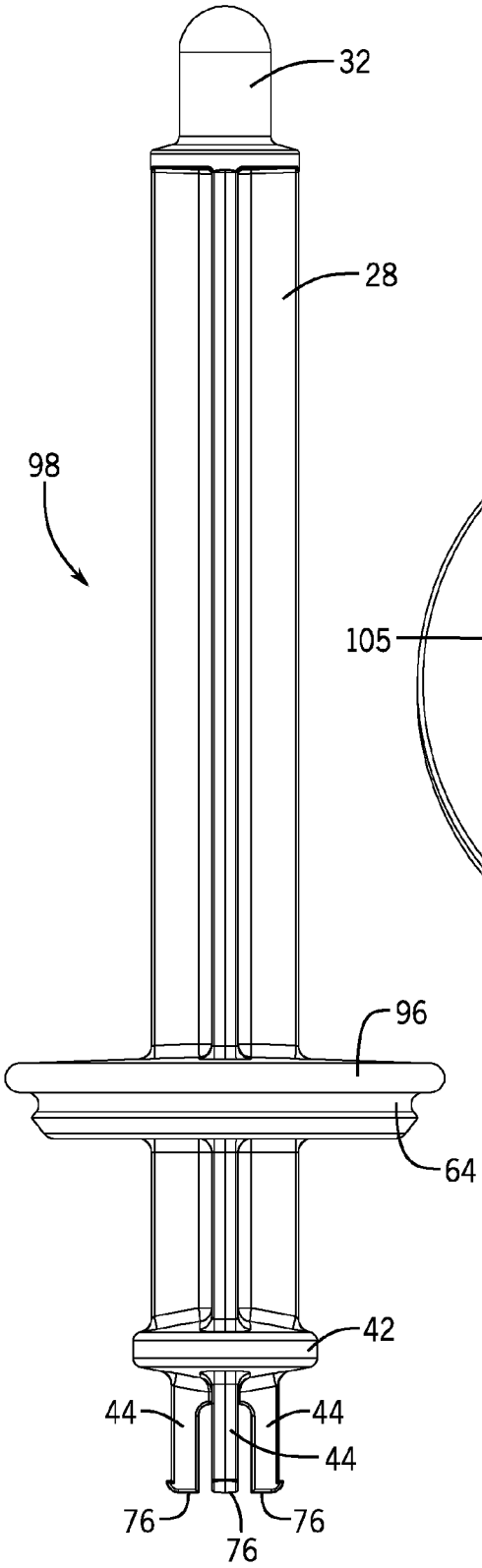
FIG. 11 is a front view of an exemplary embodiment of a piston assembly exemplarily for use with the condiment dispenser of FIGS. 9 and 10.

In the embodiment depicted, the piston assembly 98 includes an upper seat 96 which includes the interior lip 64 that connects to the biasing spring 62. As represented in this embodiment, the condiment dispenser may be arranged to dispense a single dispense portion amount, rather than offering multiple dispense portion sizes, exemplarily by switching the sealing ring, as described above. Therefore, in such exemplary embodiments, the piston assembly 98 only includes one of the upper and lower seats, and the dispenser includes the corresponding sealing ring. The dispenser 82 therefore operates in the manner as previously described with respect to one of the exemplary configurations above. The piston assembly 98 is further depicted in FIG. 11.

Figure 12:
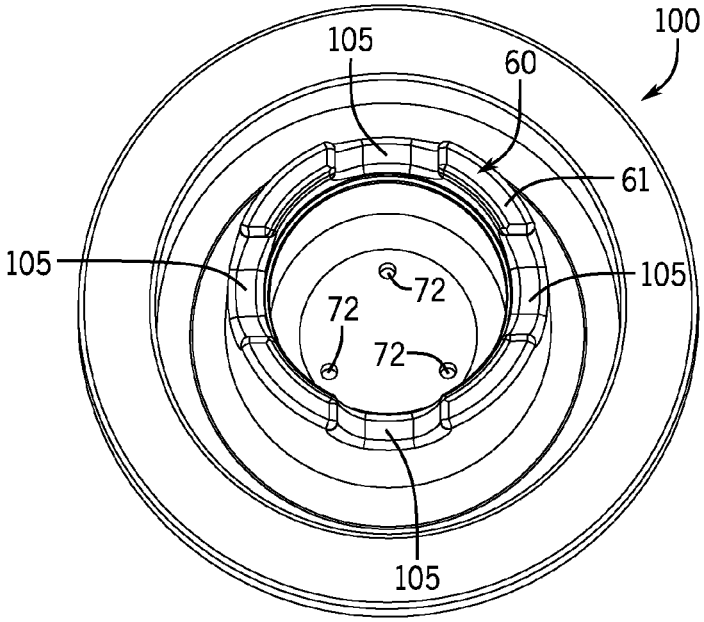
FIG. 12 is a top perspective view of an exemplary embodiment of a chamber insert.

The condiment dispenser 82 includes a chamber insert 100. The chamber insert 100, which is further depicted in FIG. 12, includes an annular lip 102 that engages an annular lip 104 that extends radially interior of the lower end 94 of the housing 84. In an exemplary embodiment, a sealing ring 103, which may be a gasket or o-ring, is located between the lips 102 and 104 to facilitate a liquid tight seal therebetween. The chamber insert 100 includes a wall 101 that extends downwardly from the engagement between these two annular lips 102, 104.

As described above, a sealing ring 74 is moveable within the inner chamber 60 of the chamber insert 100. The sealing ring 74 is respectively engageable with the lower seat 42 of the piston assembly 98 and the flanges 76 on the fingers 44 of the piston assembly 98. Thus, as described above, the sealing ring 74 "floats" within the upper and lower bounds defined by these structures. The wall 61 of the inner chamber 60 of the chamber insert 100 further includes cut-outs 105 which may facilitate flow of food product into the interior of the inner chamber 60 for dispense.

Figure 13:
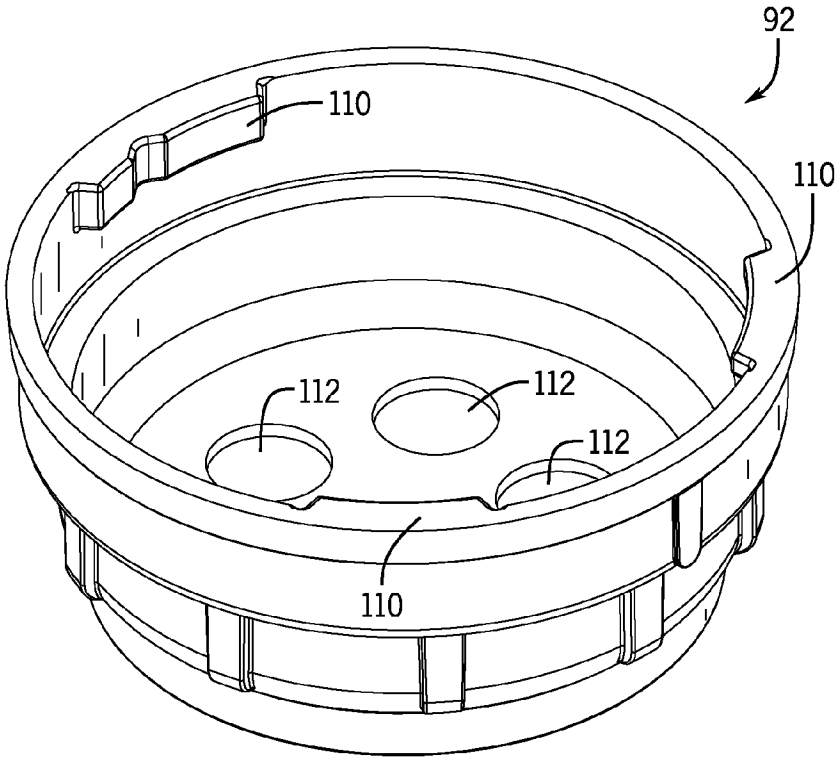
FIG. 13 is a perspective view of an exemplary embodiment of a dispenser cap.

The dispensing cap 92, which is exemplarily further depicted in FIG. 13, is removably secured to the lower end 94 of the housing 84. The lower end 94 of the housing 84 exemplarily includes a pair of opposed ridges 106 which define a recess 108 therebetween. A projection 110 of the dispensing cap 92 exemplarily is received within the recess 108 to removably secure the dispensing cap 92 to the lower end 94. In embodiments, a plurality of these connections between the projections 110 of the dispensing cap 92 and respective recesses 108 of the lower end 94 facilitate this connection.

Figure 14:
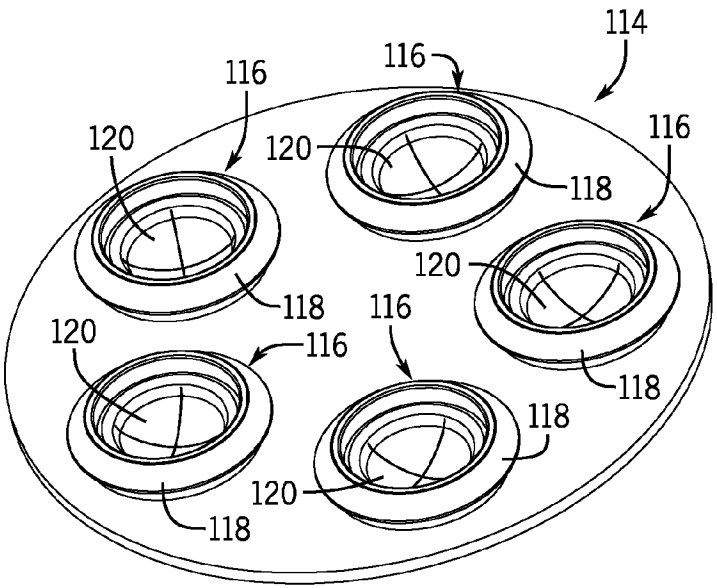
FIG. 14 is a perspective view of an exemplary embodiment of a nozzle insert.

The dispensing cap 92 further includes a bottom wall 93 with a plurality of nozzles 112 therethrough. A nozzle insert 114 is exemplarily constructed of a resilient material and is in engagement with the nozzles 112 of the dispensing cap 92. FIG. 14 is a bottom perspective view of an exemplary embodiment of a nozzle insert 114. The nozzle insert 114 includes a plurality of nozzle plugs 116 which each include an annular lip 118 that projects through the nozzle 112 and resiliently secures to a bottom side of the dispensing cap 92 to secure the nozzle insert 114 to the dispensing cap 92. Each of the nozzle plugs 116 include a plurality of resilient flaps 120 which are constructed of the same resilient material as the rest of the nozzle insert 114. In an exemplary embodiment, the resilient flaps 120 are created by a cut or cross cut in a portion of the nozzle plug 116. The resilient flaps 120 facilitate dispense of the food product out of the nozzles 112 when the food product is placed under a dispensing pressure by operation of the condiment dispenser 82. When the dispensing pressure is applied by the piston assembly 98 and sealing rings 74 is released, the resilient flaps 120 return to a normally closed position thereby closing off the nozzles 112 to further dispense of the food product. The closed nozzles also prevent air from entering the void 58 due to the aforementioned back pressure on the return stroke of the piston.

In an exemplary embodiment of the condiment dispenser as described, a piston assembly at least partially moves within a chamber, which may be a cylinder, toward and away from an end of the chamber which includes an array of orifices. Surface tension within the orifices prevent the flow of the food product through the orifices except under conditions of relative high pressure. This pressure is only generated when the piston assembly is moving into the chamber towards the orifices and pushing the food product. The food product then flows through the orifices and into a lower portion of the dispenser housing where nozzles direct the food product in an appropriate array onto the food.

Apart from when the food product is under pressure by actuation of the piston assembly, the surface tension within at least the orifices of the array of small orifices prevents food product flow through the orifices and out of the nozzles. Therefore, in exemplary embodiments the food product does not flow out of the condiment dispenser through the nozzles via the orifices due to the static pressure from the food product contained within the reservoir above the orifices. Rather, actuation of the piston is required to dispense the food product. After the piston has been actuated, a sealing ring annularly secured about the piston rod moves downward within the piston rod. the combined piston rod and sealing ring apply pressure to the food product to dispense the dispense portion from the nozzles. The fingers of the piston rod engage the sealing ring to move the sealing ring upwards and creates an opening for food product to flow from the reservoir between a valve seat and the sealing ring. This allows the cylinder to refill for a next pump stroke but limits the vacuum created in the cylinder thus limiting back pressure through the orifices which may cause reverse flow. Additionally, in embodiments of the condiment dispenser, the dispensing operation is non-drip between dispenses, even with a full load of product in the reservoir, food product is prevented from leaking out of the nozzles of the dispenser when the piston rod is not actuated.

Particular embodiments of the condiment dispenser as disclosed herein further provide a dispenser that is easier to clean and to keep sanitary than previously known and available dispensers that relied upon a mechanical check valve at the dispensing nozzle. In some exemplary embodiments, particularly related to embodiments that have a larger dispensing volume, configurations of the disclosed condiment dispenser achieves reduced wear between components of the condiment dispenser.

In still further embodiments, a common coaxial dispenser cylinder as depicted in FIGS. 3-5 is configurable and reconfigurable to dispense multiple volumes of food product. This enables a user to change between configurations to adjust the volume of food product dispensed by each actuation of the condiment dispenser. In an exemplary embodiment, this is achieved by changing a size and position of a sealing ring associated with the piston rod. In either configuration, the food product is dispensed out of the common orifices and nozzles of the condiment dispenser.

In an exemplary embodiment, the design of the piston and sealing ring of the condiment dispenser further reduces the sensitivity of the condiment dispenser to variations in density of the food products to be dispensed. The relation of the sealing ring to the piston provides a consistent volume discharge while the inventors have identified that the currently available solutions are susceptible to leaking when the condiment dispenser is used to dispense a food product that is less dense or less viscous during the actuation of the piston assembly. Thus, embodiments as disclosed herein are operable across a wide variety of food products with varying physical properties.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A condiment dispenser, comprising:

a housing defining a reservoir;

a piston assembly comprising a piston rod and a seat, the piston assembly translatable within the housing between a first position and a second position;

a chamber insert connected to a dispensing end of the housing, the chamber insert comprising an insert bottom wall and at least one orifice extending through the insert bottom wall;

a biasing spring that extends between the chamber insert and the piston assembly and biases the piston assembly in the first position;

a sealing ring engageable with the seat of the piston assembly; and a bottom wall comprising at least one nozzle, the bottom wall disposed below the chamber insert to define a void between the bottom wall and the insert bottom wall;

wherein the void between the bottom wall and the insert bottom wall and the at least one orifice extending through the insert bottom wall selectively occlude fluid flow through the at least one nozzle by surface tension within the at least one orifice.

2. The condiment dispenser of claim 1, wherein the housing comprises the bottom wall.

3. The condiment dispenser of claim 1, wherein the sealing ring engages the chamber insert.

4. The condiment dispenser of claim 3, wherein the sealing ring engages an inner surface of a wall defining the chamber insert.

5. The condiment dispenser of claim 3, wherein the chamber insert comprises an inner chamber defined by a wall extending from the insert bottom wall and the at least one orifice extends through the bottom wall within the inner chamber.

6. The condiment dispenser of claim 1, wherein the seat of the piston assembly is disengaged from the sealing ring in the first position as the piston assembly moves from the first position to the second position, the seat engages the sealing ring and translates the sealing ring within the chamber insert towards the bottom wall of the chamber insert.

7. A condiment dispenser, comprising:

a housing defining a reservoir;

a piston assembly comprising a piston rod and a seat, the piston assembly translatable within the housing between a first position and a second position;

a chamber insert connected to a dispensing end of the housing, the chamber insert comprising an insert bottom wall and at least one orifice extending through the bottom wall, the chamber insert comprising an inner chamber defined by a wall extending from the insert bottom wall and the at least one orifice extends through the bottom wall within the inner chamber;

a biasing spring that extends between the chamber insert and the piston assembly and biases the piston assembly in the first position;

a sealing ring engageable with the seat of the piston assembly engages an inner surface of the wall of the inner chamber; and a bottom wall comprising at least one nozzle, the bottom wall disposed below the chamber insert to define a void between the bottom wall and the insert bottom wall.

8. A condiment dispenser, comprising:

a housing defining a reservoir;

a piston assembly comprising a piston rod and a seat, the piston assembly translatable within the housing between a first position and a second position;

a chamber insert connected to a dispensing end of the housing, the chamber insert comprising an insert bottom wall and at least one orifice extending through the insert bottom wall, the chamber insert comprising an inner chamber defined by a wall extending from the insert bottom wall and the at least one orifice extends through the bottom wall within the inner chamber;

a biasing spring that extends between the chamber insert and the piston assembly and biases the piston assembly in the first position;

a sealing ring engageable with the seat of the piston assembly and engages an inner surface of the wall of the inner chamber; and a bottom wall comprising at least one nozzle, the bottom wall disposed below the chamber insert to define a void between the bottom wall and the insert bottom wall;

wherein the seat is an upper seat and the piston assembly further comprises a lower seat, the upper seat configured to translate with the piston assembly within the chamber insert, and the lower seat configured to translate with the piston assembly at least partially within the inner chamber.

9. The condiment dispenser of claim 8, wherein the sealing ring is selected from a first sealing ring dimensioned to engage the inner surface of the wall of the inner chamber, and a second sealing ring dimensioned to engage an inner surface of a wall defining the chamber insert.

10. The condiment dispenser of claim 9, wherein when the sealing ring is the first sealing ring, the upper seat engages the first sealing ring and when the sealing ring is the second sealing ring, the lower seat engages the second sealing ring.

11. The condiment dispenser of claim 10, wherein when the sealing ring is the first sealing ring, the condiment dispenser is arranged to dispense a portion with a first volume and when the sealing ring is the second sealing ring, the condiment dispenser is arranged to dispense the portion with a second volume.

12. A condiment dispenser, comprising:

a housing defining a reservoir;

a piston assembly comprising a piston rod and a seat, and at least one finger that extends from the seat in the direction of the dispensing end of the condiment dispenser;

a chamber insert connected to a dispensing end of the housing, the chamber insert comprising an insert bottom wall and at least one orifice extending through the bottom wall, the chamber insert comprising an inner chamber defined by a wall extending from the insert bottom wall and the at least one orifice extends through the bottom wall within the inner chamber;

a biasing spring that extends between the chamber insert and the piston assembly and biases the piston assembly in a first position;

a sealing ring engageable with the seat of the piston assembly and engages an inner surface of the wall of the inner chamber; and a bottom wall comprising at least one nozzle, the bottom wall disposed below the chamber insert to define a void between the bottom wall and the insert bottom wall;

wherein as the piston assembly moves from the first position to the second position, the seat engages the sealing ring and translates the sealing ring within the chamber insert towards the bottom wall of the chamber insert and as the piston assembly moves from the second position to the first position, the seat disengages from the sealing ring and the at least one finger engages the sealing ring and translates the sealing ring within the chamber insert away from the bottom wall of the chamber insert.

13. A condiment dispenser, comprising:

a bottom wall defining a dispensing end of the condiment dispenser, the bottom wall comprising at least one nozzle;

a housing defining a reservoir;

a chamber insert located at least partially within the housing and between the reservoir and the bottom wall, the chamber insert comprising an insert bottom wall and at least one orifice extending through the insert bottom wall wherein a surface tension of condiment in the at least one orifice constrains fluid flow therethrough;

a void defined between the bottom wall and the insert bottom wall;

a piston assembly comprising a seat, the piston assembly translatable within the housing and the chamber insert between a first position and a second position;

a biasing spring extending between the chamber insert and the piston assembly and biases the piston assembly in the first position; and a sealing ring engageable with the seat of the piston assembly, wherein translation of the piston assembly between the first position and the second position translates the sealing ring between a first position and a second position.

14. The condiment dispenser of claim 13, further comprising an end cap comprising the bottom wall, the end cap secured to the housing.

15. The condiment dispenser of claim 13, wherein the housing comprises the bottom wall.

16. The condiment dispenser of claim 13, further comprising a nozzle insert with a nozzle plug comprising a resilient valve engaged through each of the at least one nozzle in the bottom wall.

17. The condiment dispenser of claim 13, wherein the at least one orifice has a length and a diameter and the length is greater than the diameter.

18. The condiment dispenser of claim 17, wherein the length of the at least one orifice is at least 1.7 times greater than the diameter of the at least one orifice.

19. The condiment dispenser of claim 17, further comprising:

wherein when chamber insert and at least a portion of the reservoir is filled with a condiment to be dispensed, a surface tension of the condiment within the at least one orifice is greater than a force applied to the to the condiment within the at least one orifice from the condiment within the chamber insert and reservoir and the surface tension is greater than a backpressure caused by air on the at least one nozzle, preventing flow of condiment within the void and through the at least one nozzle; and wherein movement of the piston assembly from the first position to the second position applies a force on the condiment in the at least one orifice sufficient to overcome the surface tension to dispense a portion of the condiment through the at least one orifice, the void, and at least one nozzle.

20. A system for dispensing, comprising:

a housing defining a reservoir and a dispensing end defined by a bottom wall comprising at least one nozzle;

a chamber insert located within the housing and adjacent the dispensing end between the reservoir and the bottom wall, the chamber insert comprising an insert bottom wall and an inner chamber defined by an inner wall extending from the insert bottom wall;

a plurality of orifices extending through the bottom wall within the inner chamber, each of the orifices of the plurality of orifices having a length and a diameter, the length being greater than the diameter;

a void defined between the bottom wall and the insert bottom wall;

a piston assembly comprising an upper seat and a lower seat, the piston assembly translatable within the housing and the chamber insert between a first position and a second position;

a biasing spring extending between the chamber insert and the piston assembly and biases the piston assembly in the first position;

a first sealing ring engageable with the insert chamber and the upper seat of the piston assembly; and a second sealing ring engageable with the inner chamber and the lower seat of the piston assembly;

wherein one of the first sealing ring and the second sealing ring is positioned within the condiment dispenser, wherein if the first sealing ring is positioned within the condiment dispenser, the condiment dispenser dispenses a portion of condiment with a first portion volume and if the second sealing ring is positioned within the condiment dispenser, the condiment dispenser dispenses the portion of condiment with a second portion volume.

* * * * *